US011214937B2

(12) United States Patent
Li et al.

(10) Patent No.: US 11,214,937 B2
(45) Date of Patent: Jan. 4, 2022

(54) OFFSHORE PLATFORM EMBARKATION FACILITY AND OFFSHORE PLATFORM

(71) Applicant: SIEBENHAAR (SHANGHAI) OFFSHORE EQUIPMENT TECHNOLOGY CO., LTD., Shanghai (CN)

(72) Inventors: Tao Li, Yantai (CN); Gongying Lan, Yantai (CN); Xiaoliang Yang, Tongzhou (CN); Haibo Lu, Taicang (CN); Jun Jin, Xuzhou (CN); Rongqiang Zhao, Nantong (CN); Shenlin Yang, Yangzhong (CN)

(73) Assignee: SIEBENHAAR (SHANGHAI) OFFSHORE EQUIPMENT TECHNOLOGY CO., LTD., Shanghai (CN)

( * ) Notice: Subject to any disclaimer, the term of this patent is extended or adjusted under 35 U.S.C. 154(b) by 161 days.

(21) Appl. No.: 16/480,633

(22) PCT Filed: Jan. 31, 2019

(86) PCT No.: PCT/CN2019/074253
§ 371 (c)(1),
(2) Date: Jul. 24, 2019

(87) PCT Pub. No.: WO2019/227965
PCT Pub. Date: Dec. 5, 2019

(65) Prior Publication Data

US 2021/0115640 A1 Apr. 22, 2021

(30) Foreign Application Priority Data

May 30, 2018 (CN) ..... 201810554221.1

(51) Int. Cl.
*E02B 17/08* (2006.01)
*E02B 17/02* (2006.01)
(Continued)

(52) U.S. Cl.
CPC ..... *E02B 17/0863* (2013.01); *B63B 27/16* (2013.01); *B63B 35/44* (2013.01);
(Continued)

(58) Field of Classification Search
CPC ..... B63B 79/10; B63B 27/16; B63B 79/40; B63B 35/44; E02B 17/0863; E02B 17/021; E02B 2017/006
See application file for complete search history.

(56) References Cited

U.S. PATENT DOCUMENTS 2,900,794 A * 8/1959 Sutton ..... E02B 17/021 405/204
3,277,653 A * 10/1966 Foster ..... E02B 17/021 405/200
(Continued)

FOREIGN PATENT DOCUMENTS

CN 204326042 U 5/2015
CN 105173007 A 12/2015
(Continued)

OTHER PUBLICATIONS

International Search Report dated Apr. 28, 2019 in PCT Application No. PCT/CN2019/074253, filed Jan. 31, 2019.

*Primary Examiner* — Edwin J Toledo-Duran
(74) *Attorney, Agent, or Firm* — Perry + Currier Inc.; Alan F. Feeney

(57) ABSTRACT

An offshore platform embarkation facility and an offshore platform, including a lift tower, wherein the lift tower is provided with a climbing device and the lift tower is provided with a transmission structure; a jacking frame,
(Continued)

wherein a first moon pool allowing the lift tower to pass through is provided in the jacking frame; a lifting unit, wherein the lifting unit is installed on the jacking frame and the lifting unit is configured to cooperate with the transmission structure to raise and lower the lift tower; a lift platform, wherein a second moon pool allowing the lift tower to pass through is provided in the lift platform, and the lift platform is connected with the lift tower via the climbing device, and the lift platform is located below the jacking frame. When it is needed to load or unload personnel or goods, it is not required to lower the entire offshore platform to the height of the sea surface to enable a ship to be anchored, anchorage of ships and loading or unloading of personnel and goods can be quickly completed simply by means of the offshore platform embarkation facility, which saves energy consumption and time, improves the work efficiency and increases the service life of the offshore platform.

16 Claims, 6 Drawing Sheets

(51) Int. Cl.

| | |
|---|---|
| ***B63B 79/40*** | (2020.01) |
| ***B63B 79/10*** | (2020.01) |
| ***B63B 27/16*** | (2006.01) |
| ***B63B 35/44*** | (2006.01) |
| *E02B 17/00* | (2006.01) |

(52) U.S. Cl.
CPC ..... *B63B 79/10* (2020.01); *B63B 79/40* (2020.01); *E02B 17/021* (2013.01); *E02B 2017/006* (2013.01)

(56) References Cited

U.S. PATENT DOCUMENTS 3,686,811 A * 8/1972 Hayes ..... E02B 17/0008 52/223.2
3,991,837 A * 11/1976 Crickmer ..... E21B 19/09 175/27
4,199,276 A * 4/1980 Molsberger ..... E02B 17/0872 405/198
4,640,647 A * 2/1987 Blair ..... E02B 17/00 166/368
4,678,165 A * 7/1987 Eloranta ..... E02B 17/0818 254/97
4,841,895 A * 6/1989 Brewerton ..... B63B 21/507 114/230.12
6,309,160 B1 * 10/2001 Greene, Jr. ..... B63B 27/10 114/362
6,439,936 B1 * 8/2002 Dreith ..... B63B 17/0018 114/144 B
6,470,969 B1 * 10/2002 Sørhaug ..... E21B 19/006 166/355
10,384,917 B2 * 8/2019 Hansen ..... B60P 1/6427
2009/0178722 A1 * 7/2009 Howard ..... B63B 35/44 138/106
2011/0011320 A1 * 1/2011 Yemington ..... B66C 13/02 114/122
2011/0168402 A1 * 7/2011 C. Nadarajah ..... E02B 17/00 166/365
2013/0305632 A1 * 11/2013 Rivera, Sr. ..... E21B 7/02 52/117
2014/0224499 A1 * 8/2014 Sanders ..... E21B 19/00 166/339
2015/0240442 A1 * 8/2015 Garcia-Valdecasas Bernal ..... E02D 23/02 405/208
2018/0135267 A1 * 5/2018 Reales Bertomeo ..... E02B 17/0017
2018/0155995 A1 * 6/2018 Van Der Hoorn ..... E21B 15/02
2018/0230662 A1 * 8/2018 Khodr ..... E02B 17/021

FOREIGN PATENT DOCUMENTS

| | | | |
|---|---|---|---|
| CN | 205034299 | U | 2/2016 |
| CN | 108045509 | A | 5/2018 |
| CN | 108298035 | A | 7/2018 |
| CN | 108639256 | A | 10/2018 |
| CN | 208053585 | U | 11/2018 |
| CN | 208377011 | U | 1/2019 |
| EP | 2812239 | B1 | 5/2016 |
| KR | 101475273 | B1 | 12/2014 |

* cited by examiner

OFFSHORE PLATFORM EMBARKATION FACILITY AND OFFSHORE PLATFORM

CROSS-REFERENCE TO RELATED APPLICATIONS

The present disclosure claims priority to Chinese patent application with the filing NO. CN201810554221.1, filed with the Chinese Patent Office on May 30, 2018 and entitled "Offshore Platform Embarkation Facility and Offshore Platform", the contents of which are incorporated herein in its entirety.

TECHNICAL FIELD

The present disclosure relates to the field of offshore platforms, in particular, to an offshore platform embarkation facility and an offshore platform.

BACKGROUND ART

Offshore platforms (jack-up platforms) are structures providing production and living facilities for activities such as well drilling, oil exploitation, concentrated transportation, observation, navigation and construction. Offshore platforms may be divided into a fixed type and a movable type according to their structural characteristics and operation states. A lower portion of a fixed type platform is directly supported and fixed to the seabed by means of piles, spread footings or other structures. A movable platform floats in water or is supported on the seabed, and can move from one well site to another well site.

However, in case of loading and unloading of personnel or goods, the existing offshore platforms are very inconvenient, and it is usually required to retract fixation piles embedded in the sea and serving a supporting function to bring an entire offshore platform down to the sea surface, such that ships can be anchored at edges of the offshore platform so as to load and unload personnel and goods. This method is very energy-consuming and wastes a lot of time, and interrupts normal operations of the offshore platform, resulting in a quite poor flexibility of the offshore platform.

SUMMARY

The present disclosure provides an offshore platform embarkation facility and an offshore platform, aiming at solving the problem with the existing offshore platform that the entire platform is required to be brought down to the sea surface when loading and unloading personnel or goods, and for each time of loading or unloading, normal operations of the platform need to be interrupted, which is energy-consuming and time-consuming.

The technical solutions provided in the present disclosure are as follows:

An offshore platform embarkation facility, including a lift tower (frame), wherein the lift tower is provided with a climbing device and the lift tower is provided with a transmission structure; a jacking frame (fixed pile frame), wherein a first moon pool allowing the lift tower to pass through is provided in the jacking frame; a lifting unit, wherein the lifting unit is installed on the jacking frame and is configured to cooperate with the transmission structure to raise and lower the lift tower; a lift platform, wherein a second moon pool allowing the lift tower to pass through is provided in the lift platform, and the lift platform is connected with the lift tower via the climbing device, and the lift platform is located below the jacking frame.

Furthermore, a (position) limiting device is fixedly mounted at a bottom end of the lift tower, wherein the limiting device is configured to restrict a movable range of the lift platform on the lift tower.

Furthermore, at least one set of rollers is further included, wherein the at least one set of rollers is mounted on the lift platform with the rollers close to the second moon pool, and cooperates with the transmission structure, and the at least one set of rollers is configured to allow the lift platform to slide up and down along the lift tower.

Furthermore, the lift platform is hollow inside.

Furthermore, the climbing device at least includes a stairway and an elevator, wherein the stairway is arranged on the lift tower from top to bottom, an upper end of the stairway is connected with the jacking frame, a ramp (movable stairs) is connected with a lower end of the stairway, a lower end of the ramp can slide on an upper surface of the lift platform for connecting the lift platform and the stairway, the lower end of the stairway is provided with a limiting device configured to restrict a rotation angle of the ramp to a range of 15°~60°, and the elevator is arranged on the lift tower.

Furthermore, the lifting unit includes a (speed) reduction device and a power device, wherein an output end of the power device is connected with an input end of the reduction device, and an output end of the reduction device cooperates with the transmission structure.

Furthermore, at least one roller support device is respectively provided at each of two sides to which the lift tower swings relative to a vertical direction, wherein each roller support device includes: a base, a roller and a roller carrier, the base is mounted on the jacking frame, the roller carrier is mounted on the base, and the roller is rotatably connected with one side of the roller carrier and abuts the lift tower, wherein when the lift tower is raised or lowered, the roller rotates in a vertical direction around an axis of itself.

Furthermore, a wedge groove (slot) is formed between an upper portion of the roller carrier and the lift tower, wherein when an attitude of the lift tower is fixed, a wedge for pile fixation is inserted in the wedge groove, with the wedge for pile fixation abutted against the wedge groove.

Furthermore, a sensor and an electrical control system are further included, wherein the sensor is installed below the jacking frame and is configured to sense a spacing between the lift platform and the jacking frame, and the electrical control system is in communication connection with the lifting unit, the elevator and the sensor respectively.

An offshore platform, including the above offshore platform embarkation facility, wherein when the offshore platform needs to move, the lifting unit enables the lift tower to move upward by driving the transmission structure, so as to elevate the lift platform until it leaves the sea surface; and when the offshore platform needs to be stationed, the lifting unit enables the lift tower to move downward by driving the transmission structures such that the lift platform is lowered onto the sea surface.

Compared with the prior art, the offshore platform embarkation facility and the offshore platform provided in the present disclosure bring at least one of the following technical effects:

(1) With the offshore platform embarkation facility and the offshore platform provided in the present disclosure, when it is needed to load or unload personnel or goods, it is not required to lower the entire offshore platform to the height of the sea surface to enable a ship to be anchored, loading or unloading of personnel and goods can be quickly completed simply by means of the offshore platform embarkation facility, and when loading goods, it is not required to stop normal operations of the offshore platform, which saves energy consumption and time, improves the work efficiency and increases the service life of the offshore platform.

(2) For the offshore platform embarkation facility and the offshore platform provided in the present disclosure, when the offshore platform embarkation facility is in a use state, the lift platform can float in water with a self-adaption to its height, and adjust its position on the lift tower without the need of manually adjusting the height of the lift platform.

(3) For the offshore platform embarkation facility and the offshore platform provided in the present disclosure, when the offshore platform is ready to change its stationing location, the entire offshore platform embarkation facility may be retracted to leave the sea surface, which will not affect normal sailing of the entire offshore platform and has a small effect on the offshore platform.

BRIEF DESCRIPTION OF DRAWINGS

An offshore platform embarkation facility and an offshore platform are to be further described in a clear and understandable manner in connection with preferred embodiments illustrated by the accompanying drawings.

REFERENCE SIGNS

Figure 1:
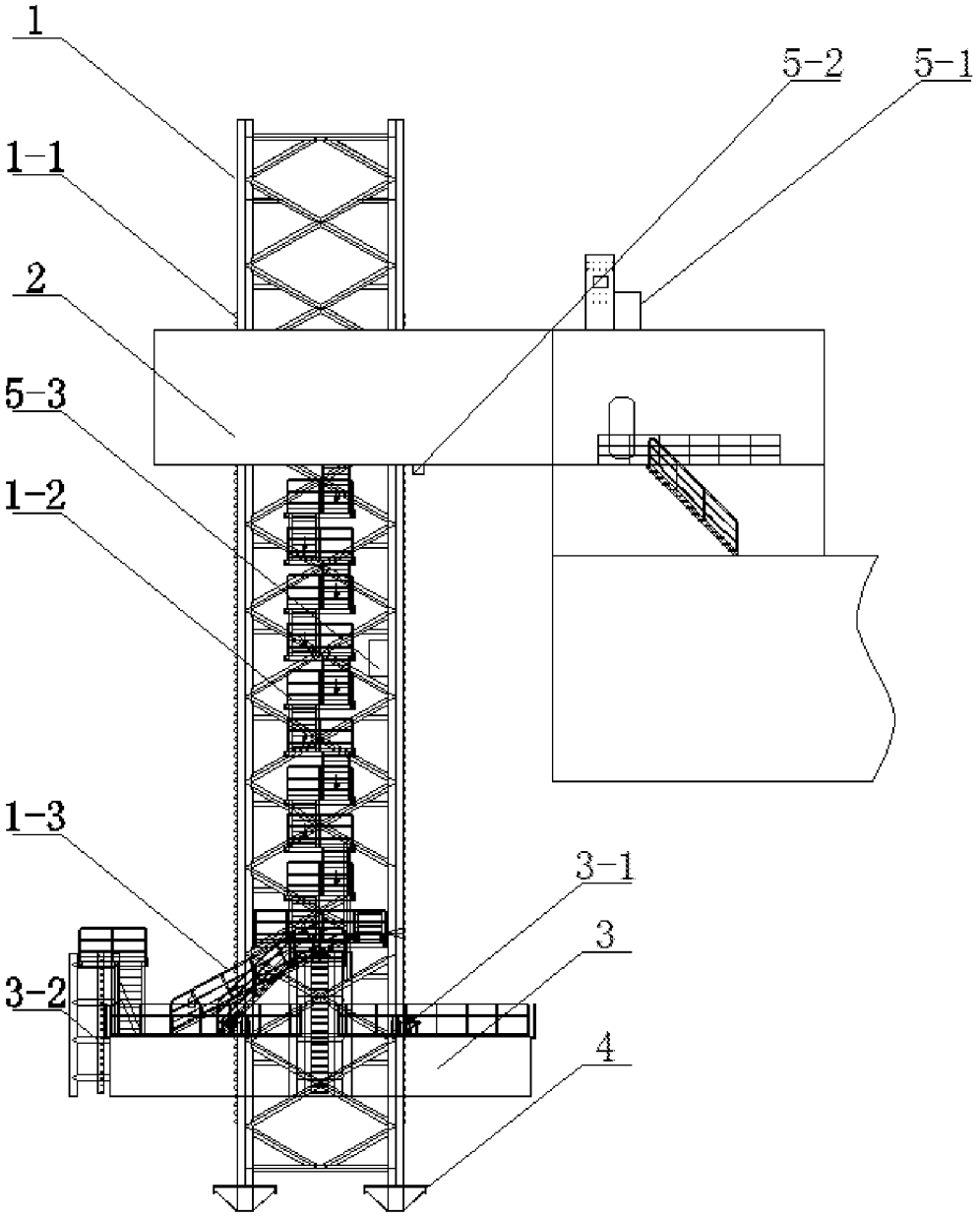
FIG. 1 is a structural schematic diagram of an offshore platform embarkation facility and an offshore platform provided in the present disclosure.

1 lift tower, 1-1 transmission structure, 1-2 stairway, 1-3 ramp, 1-4 tower pile,

2 jacking frame, 2-1 lifting unit, 2-1-1 reduction device, 2-1-2 power device, 2-2 roller support device. 2-2-1 base, 2-2-2 roller, 2-2-3 roller carrier, 2-2-4 handle,

3 lift platform, 3-1 at least one set of rollers, 3-2 ship mooring column,

4 limiting device,

5-1 electrical control system, 5-2 sensor, and 5-3 elevator.

DETAILED DESCRIPTION OF EMBODIMENTS

In order to more clearly illustrate technical solutions in the embodiments of the present disclosure or in the prior art, the specific embodiments of the present disclosure will be described in the following with reference to accompanying drawings. Apparently, the accompanying drawings in the following description are merely for some embodiments of the present disclosure, and for a person ordinarily skilled in the art, other accompanying drawings can also be obtained according to these accompanying drawings without using creative effort, and other embodiments can be obtained as well.

In order to make the drawings brief, only parts which are relevant to the present disclosure are represented in the drawings merely in an illustrative way, and they do not represent actual structures of a product. In additions, in order to make the drawings brief and easily understandable, in some drawings, elements having the same structure or function are merely illustratively depicted as one among them, or only one among them is denoted. In the context of the present disclosure, "a/an" not only signifies "only one", but also signifies the case of "more than one".

Figure 2:
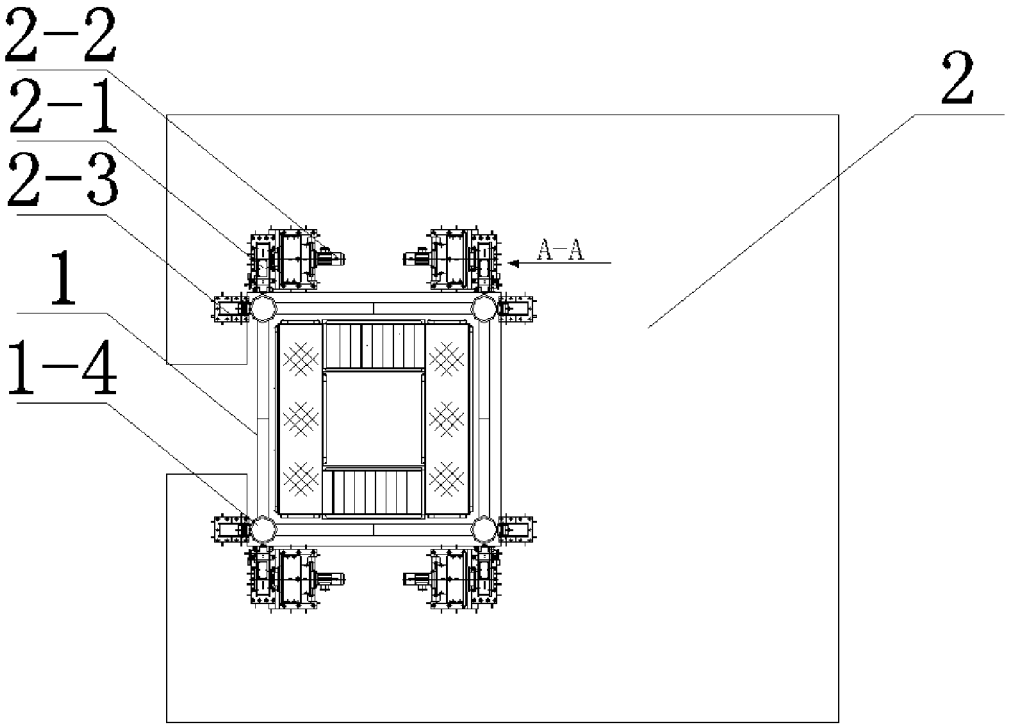
FIG. 2 is a structural top view of a jacking frame.
Figure 7:
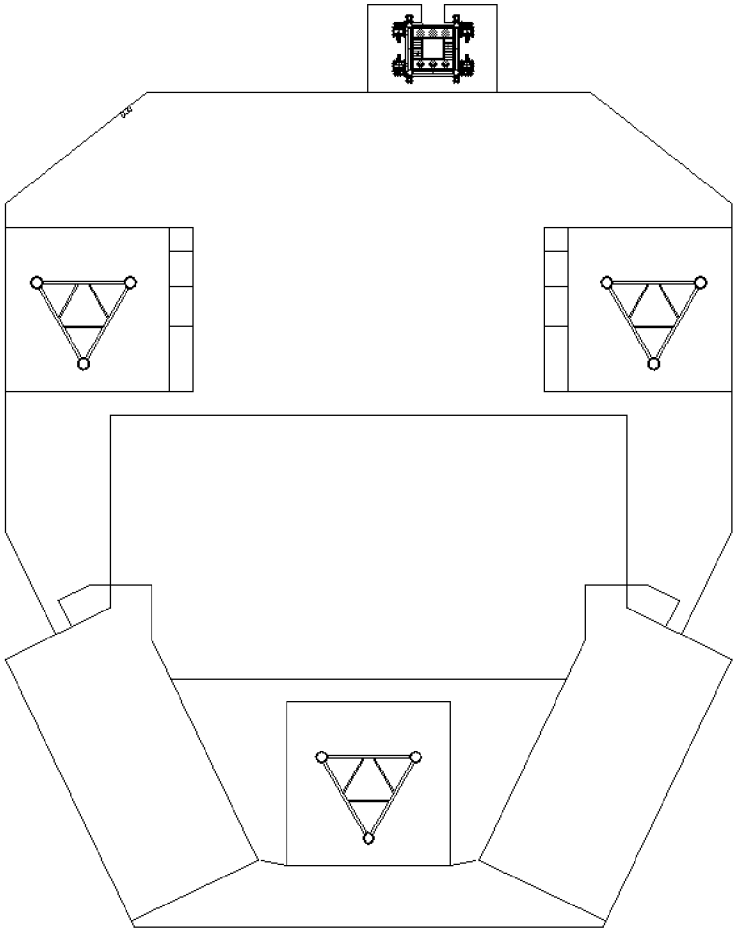
FIG. 7 is a structural top view of the offshore platform embarkation facility and the offshore platform provided in the present disclosure.

In embodiment 1, referring to what is shown in FIG. 1, FIG. 2 and FIG. 7, the present disclosure provides an offshore platform embarkation facility, including a lift tower 1, wherein the lift tower 1 is provided with a climbing device, and the lift tower 1 is provided with transmission structures 1-1; a jacking frame 2, wherein a first moon pool allowing the lift tower 1 to pass through is provided in the jacking frame 2; lifting units 2-1, wherein the lifting units 2-1 are installed on the jacking frame 2, and the lifting units 2-1 are configured to cooperate with the transmission structures 1-1 to raise and lower the lift tower 1; a lift platform 3, wherein a second moon pool allowing the lift tower 1 to pass through is provided in the lift platform 3, the lift platform 3 is connected with the lift tower 1 via the climbing device, and the lift platform 3 is located below the jacking frame 2.

In practical applications, the lift tower 1 should be composed of at least three tower piles 1-4, otherwise a stable frame capable of withstanding ocean waves and ocean currents cannot be formed. In the present embodiment, the lift tower 1 is composed of four tower piles 1-4 with square cross sections, wherein each tower pile 1-4 separately corresponds to one lifting unit 2-1, and when the lift tower 1 needs to be raised or lowered, the four lifting units 2-1 work simultaneously such that movement actions of the lift tower 1 are sable without shaking. Among the four lifting units 2-1, as long as three lifting units 2-1 can work normally at the same time, or a pair of lifting units 2-1 arranged diagonally can work normally at the same time, or a pair of lifting units 2-1 arranged oppositely can work normally at the same time, raising and lowering of the lift tower 1 can be substantially achieved despite that slight shaking may occur during operation movements of the lift tower 1. In other embodiments, the lift tower 1 may be a lift tower 1 with a triangular cross section formed by three tower piles 1-4, or other solutions may be adopted to form a stable lift tower 1, wherein each tower pile 1-4 does not necessarily correspond to its respective lifting unit 2-1, as long as the raising and lowering of the lift tower 1 can be achieved. The tower piles 1-4 and the lift tower 1 are not obliged to be arranged vertically, the lift tower 1 can have a certain inclination as required, the first moon pool and the second moon pool can accordingly be adjusted in structure to adapt to the inclined lift tower 1, and the desired technical effects of the present disclosure can still be achieved without changing the basic structure of the offshore platform embarkation facility. In the present embodiment, each transmission structure 1-1 is a structure in which gears cooperate with racks, specifically, the gears are detachably mounted at an input end of the respective lifting unit 2-1, the racks are mounted on the tower pile 1-4 corresponding to the lifting unit 2-1, and the gears and the racks are in mesh connection. In other embodiments, the racks are not obliged to be arranged on the tower pile 1-4, but can be arranged on the lift tower 1, and other types of transmission structures such as belt drive also may be used to enable the lifting units 2-1 to drive the lift tower 1 to raise or lower.

The lift platform 3 is configured to moor a ship, and a ship mooring column 3-2 is arranged at an edge of the lift platform 3. In the present embodiment, since the lift platform 3 is also provided in a square form, except for a side facing the offshore platform, all of other three sides thereof are available for anchorage of ships, accordingly, the three sides available for anchorage of ships are each provided with a ship mooring column 3-2. Each ship mooring column 3-2 is provided with an anchorage platform and a transition stairway, wherein the transition stairway extends from the anchorage platform down to a platform surface of the lift platform 3, a side of each ship mooring column 3-2 facing the sea is provided with a shock absorber such as sponge or swim ring to prevent impact during anchorage of ships from damaging the ship mooring columns 3-2 and anchored ships.

When the offshore platform embarkation facility is in a use state, ships may be anchored at edges of the lift platform 3, and personnel and goods may embark on the lift platform 3 via the ship mooring columns 3-2 and arrive at the jacking frame 2 via the stairway 1-2, the elevator 5-3 or other means, so as to embark on a deck of the offshore platform. When the offshore platform is continously stationary, the offshore platform embarkation facility may be continuously in a use state, that is, the lift platform 3 is always on the sea surface and is constantly ready for anchorage of transport ships; when the ship offshore platform needs displacement, the offshore platform embarkation facility is shifted to a non-use state, specifically, the lifting units 2-1 drive the lift tower 1 to raise through the transmission structure 1-1, a bottom end of the lift tower 1 leaves the sea, and the lift tower 1 drives the lift platform 3 to raise until it closely abuts a bottom of the jacking frame 2, then the supporting piles of the offshore platform can be retracted to make a displacement of the offshore platform. Since the entire offshore platform embarkation facility is retracted and leaves the sea surface, no part in the offshore platform embarkation facility will affect the offshore platform under sail, without occurrence of situations such as scratching reefs on the seabed. During extreme weather conditions on the offshore platform, the offshore platform embarkation facility should also be shifted to the non-use state to avoid continuous impacts on the lift platform 3 and the lift tower 1 from ocean waves and ocean currents, which cause damages to the offshore platform embarkation facility and the offshore platform.

In embodiment 2, referring to what is shown in FIG. 1, a limiting device 4 is fixedly mounted at the bottom end of the lift tower 4, wherein the limiting device 4 is configured to restrict a movable range of the lift platform 3 on the lift tower 1.

In practical applications, in order to save materials, weight and cost, the limiting device 4 may be provided in form of an inverted triangle and a buffer layer is arranged on a contact surface between the limiting device 4 and the lift platform 3, wherein the buffer layer may be made of materials such as sponge to prevent damages to the lift platform 3 and the limiting device 4 when the limiting device 4 is in contact with the lift platform 3. Moreover, a contact area between the limiting device 4 and the lift platform 3 should be as large as possible so as to reduce a pressure at the contact surface such that the contact surface between the lift platform 3 and the limiting device 4 easily bears the weight of the lift platform 3 itself, and is less prone to damages.

Figure 3:
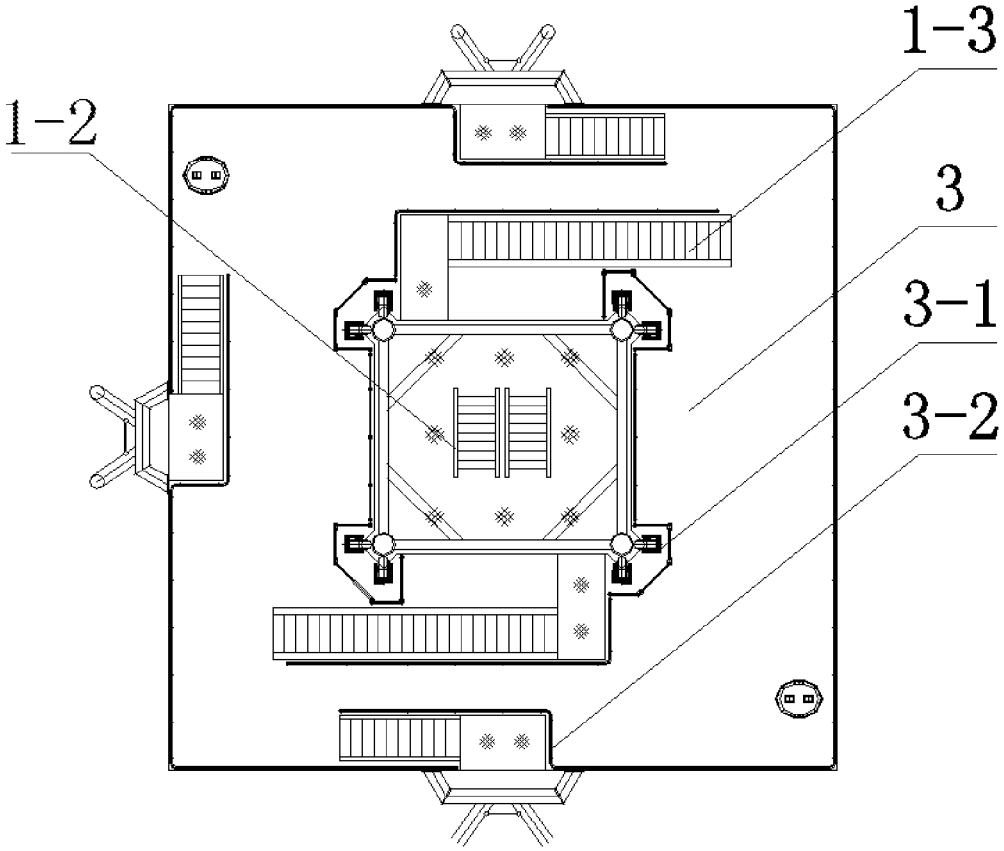
FIG. 3 is a structural top view of a lift platform.

In embodiment 3, referring to what is shown in FIG. 1 and FIG. 3, at least one set of rollers 3-1 is further included, wherein the at least one set of rollers 3-1 is mounted on the lift platform 3 close to the second moon pool, and cooperates with the transmission structure 1-1, and the at least one set of rollers 3-1 is configured to allow the lift platform 3 to slide up and down along the lift tower 1.

In practical applications, since the lift platform 3 is often subjected to impacts from ocean waves, forces departing from a vertical direction of the lift tower 1 may be generated, then if not limited, the lift platform 3 is very prone to shakings and offsets, which causes scratching between the lift tower 1 and an inner wall of the second moon pool, damaging the lift platform 3 and the lift tower 1, therefore, at least one set of rollers 3-1 is arranged on the lift platform 3 for restricting vertical slide of the lift platform 3 along the lift platform 1. In the present embodiment, since the lift tower 1 is composed of four tower piles 1-4, four sets of rollers 3-1 respectively cooperating with the four tower piles 1-4 are arranged on the lift platform 3, wherein two rollers are provided in each set of rollers 3-1, the two rollers orthogonally abut against the respective tower pile 1-4 in two directions so as to avoid possibility of horizontal displacement of the lift platform 3. The four sets of rollers 3-1 cooperate with each other to allow the lift platform 3 to slide only vertically along the lift tower 1, ensuring the security of personnel or goods on the lift platform 3 during loading or unloading. In other embodiments, since the cross section shape of the lift tower 1 and the arrangement of the tower piles 1-4 may be different from the present embodiment, the number of the at least one set of rollers 3-1 and an cooperation angle of multiple rollers in each set of the rollers 301 also will be changed thereby, for example, when the lift tower 1 is composed of three tower piles 1-3, the cross section of the lift tower 1 is triangular, correspondingly, the shape of the second moon pool is corresponding thereto and is also triangular, then each tower pile 1-4 is provided with one set of rollers 3-1, wherein each set of rollers 3-1 has two rollers in cooperation, and the two rollers are oppositely arranged with respect to an angular bisector of a vertex on the corresponding tower pile 1-4. This arrangement will prevent horizontal movement or rotational movement of the lift platform 3. Any method in which installation structures of at least one set of rollers 3-1 on the lift platform 3 are correspondingly varied according to different structures of the lift tower 1 shall fall within the scope of protection of the present disclosure.

In embodiment 4, the lift platform 3 is hollow inside.

In practical applications, when the offshore platform embarkation facility is in the use state, the lift platform 3 should have a self-adjustment function, and the so-called self-adjustment function refers to automatically adjusting a position of the lift platform 3 on the lift tower 1, i.e., the height of the lift platform 3, according to height of the sea surface. In the present disclosure, in order to realize the above self-adjustment function, the lift platform 3 is designed to be hollow inside, and when the lift platform 3 is laid on the sea surface, due to air bubbles stored in hollow parts inside the lift platform 3, the lift platform 3 can be enabled to produce a buoyancy sufficient for floating on the water surface, and when the sea surface rises or recedes, the lift platform 3 can self-adjust its position on the lift platform 3 based on the height of the sea surface without manually controlling or adjusting by means of a mechanical or electrical system, thus saving labors and resources. The lift platform 3 may be provided in a box type or a skirt type, wherein the so-called box type refers to a structure in which an internal space of the lift platform 3 is fully closed; while the skirt type only has plate surfaces on an upper surface and four peripheral surfaces of the lift platform, but lacks a bottom plate compared with the box type. Both of the two design patterns can attain the self-adjustment function to be achieved in the present disclosure.

In the previous embodiment, the lift platform 3 can slide up and down on the lift tower 1 by means of at least one set of rollers 3-1, while in practical applications, if low-amplitude and high-frequency fluctuations of the sea surface happen during loading and unloading of personnel or goods, in connection with the present embodiment, if left uncontrolled, the lift platform 3 will also be raised and lowered in high frequency along with the fast fluctuations of the sea surface, thus personnel are prone to stand unsteadily on the lift platform 3 and get injured, and goods are also prone to be damaged in shaking. Therefore, the at least one set of rollers 3-1 in the present disclosure is provided with a locking system, wherein the locking system can lock up the at least one set of rollers 3-1 and prevent them from rotating, such that the lift platform 3 is controlled to be at a fixed position on the lift tower 1. The locking system may be opened or closed manually in a mechanical way, or may be controlled by the electrical system of the offshore system. In practical applications, if low-amplitude and high-frequency fluctuations of the sea surface happen, the lift platform 3 should be stopped and locked at a position of a highest wave crest on the current sea surface such that a pressure on the at least one set of rollers 3-1 is reduced by occasional buoyancy, without allowing seawater to spill over the lift platform 3 and hurt personnel or goods on the lift platform 3.

In embodiment 5, referring to what is shown in FIG. 1, the climbing device at least includes a stairway 1-2 and an elevator 5-3, wherein the stairway 1-2 is arranged on the lift tower 1 from top to bottom, an upper end of the stairway 1-2 is connected with the jacking frame 2, a ramp 1-3 is connected with a lower end of the stairway, the lower end of the ramp 1-3 slides on an upper surface of the lift platform 3 for connecting the lift platform 3 and the stairway 1-2, the lower end of the stairway 1-2 is provided with a limiting device 4 configured to restrict a rotation angle of the ramp 1-3 to a range of 15°~60°, and the elevator 5-3 is arranged on the lift tower 1.

In practical applications, the stairway 1-2 may be arranged in the internal space of the lift tower 1, in the present disclosure, the stairway 1-2 is a spiral staircase 1-2, a transition portion between each two adjacent steps of the stairway 1-2 is of platform type for facilitating personnel climbing the stairway to rest or temporarily placing goods, a ramp 1-3 is connected with the lower end of the stairway 1-2, a lower end of the ramp 1-3 can slide on the upper surface of the lift platform 3, once the height of the lift platform 3 fluctuates, the ramp 1-3 can change its angle by itself to adapt to height changes of the lift platform 3, a bottom end of the ramp 1-3 may be provided in a roller type, and it is also feasible to arrange a slot matching the bottom end of the ramp 1-3 on the upper surface of the lift platform 3 so as to facilitate the bottom end of the ramp 1-3 to slide on the lift platform 3; considering the case that personnel in charge of loading/unloading may not feel well or the possibility that goods are too heavy to be conveniently conveyed via the stairway 1-2, an elevator 5-3 may be installed on the lift tower 1 to solve the above problems. A lowest position where the elevator 5-3 runs may be corresponding to a platform at an upper end of the ramp 1-3, and personnel or goods unloaded from the elevator 5-3 may move or be moved to the lift platform 3 via the ramp 1-3. The jacking frame 2 may have one end configured to connect the stairway 1-2 and the elevator 5-2, and the other end configured to be connected with a pedestrian path of the offshore platform, and it is also feasible to open up a pedestrian path on the upper surface of the jacking frame 2 for facilitating passage of personnel and transport of goods.

Figure 5:
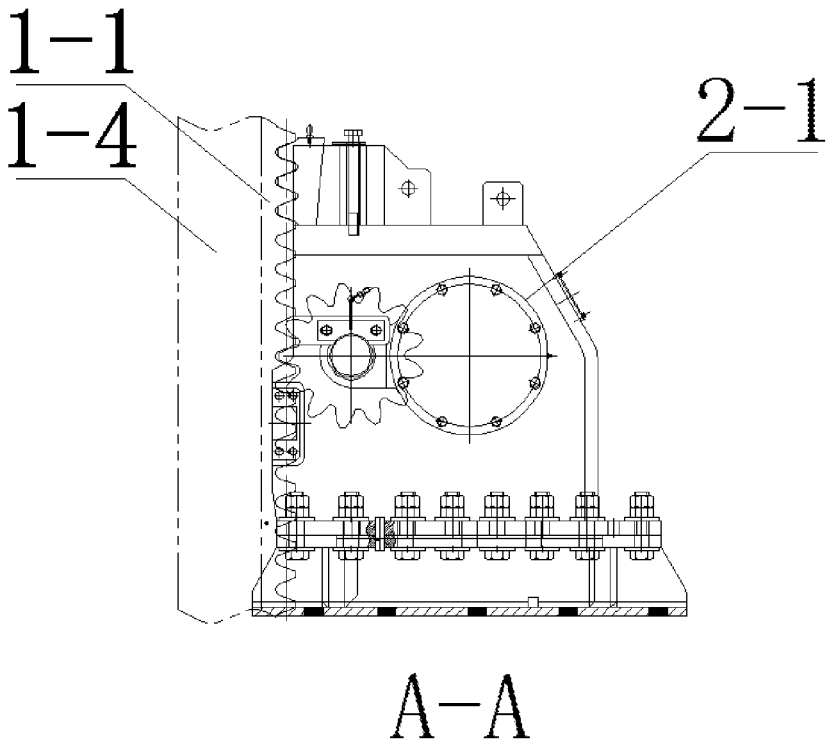
FIG. 5 is a view of A-A of a lifting unit in FIG. 2.
Figure 6:
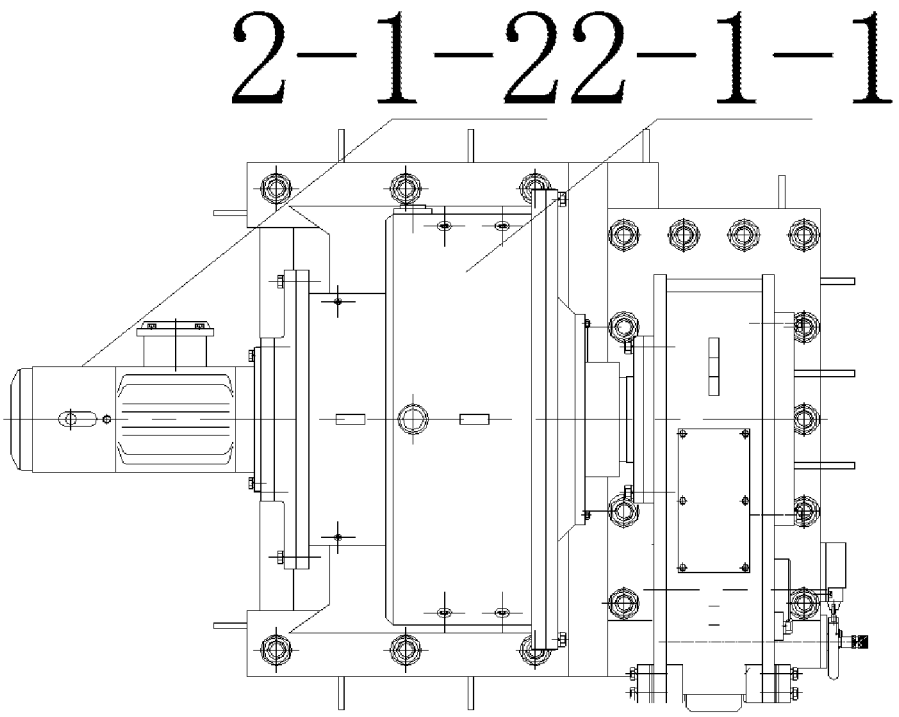
FIG. 6 is a structural schematic diagram of a lifting unit.

In embodiment 6, referring to what is shown in FIG. 5 to FIG. 6, each lifting unit 2-1 includes a reduction device 2-1-1 and a power device 2-1-2, wherein an output end of the power device 2-1-2 is connected with an input end of the reduction device 2-1-1, and an output end of the reduction device 2-1-1 cooperates with the transmission structure 1-1.

In practical applications, a rev at the output end of the power device 2-1-2 is relatively fast, while a speed of raising and lowering of the lift tower 1 has to be relatively slow to ensure stability and security. Therefore, power transmitted to the transmission structure 1-1 can only be used only after speed reduction with high transmission ratio by the reduction device 2-1-1. In the present embodiment, the power device 2-1-2 may be a motor, and the reduction device 2-1-1 respectively employs a differential planetary reduction gearbox and a terminal reduction gearbox in cooperation to perform a speed reduction of two levels (two-stage speed reduction), the reason for employing two types of reduction gearboxes to perform the speed reduction of two levels is: the offshore platform embarkation facility in the present disclosure has a relatively small volume, if a resultant output power applicable to the transmission structure 1-1 is to be achieved only by a speed reduction of one level, a volume of the reduction gearbox will be excessively large, thus a manner in which two reduction gearboxes are in cooperation is employed to perform the speed reduction of two levels, so as to achieve the resultant output power conforming to specifications. In the above, a power output end of the motor is in detachable connection with a power input end of the differential planetary reduction gearbox, a power output end of the differential planetary reduction gearbox is in detachable connection with a power input end of the terminal reduction gearbox, and in connection with embodiment 1, the power output end of the terminal reduction gearbox is in detachable connection with the gears, and the gears are in mesh connection with the racks on the lift tower 1 to form the transmission structure 1-1, so as to realize that the motor drives the gears to rotate on the racks, driving movements of raising and lowering of the lift tower 1. In the present embodiment, the power device 2-1-2 is provided therein with a brake device, which can stop, at any time, the raising and lowering of the lift tower 1, and can also continuously keep an attitude of lift tower 1 still. In other embodiments, other power devices 2-1-2 apart from the motor may be selected, or reduction devices 2-1-1 of reduction gearboxes of other specifications may be selected, and it is not obligatory to have two reduction gearboxes to achieve the speed reduction. Multiple reinforcing ribs extend from an outer side surface of the reduction device 2-1-1 in the present embodiment, with the reinforcing ribs perpendicular to the outer side surface of the reduction device 2-1-1 and abuting against a mounting surface of the reduction device 2-1-1, when the lift tower 1 produces a horizontal force, the reinforcing ribs can maintain a normal attitude of the reduction device 2-1-1 and assist the lift tower 1 in maintaining the normal attitude when being stationary or in movement.

Figure 4:
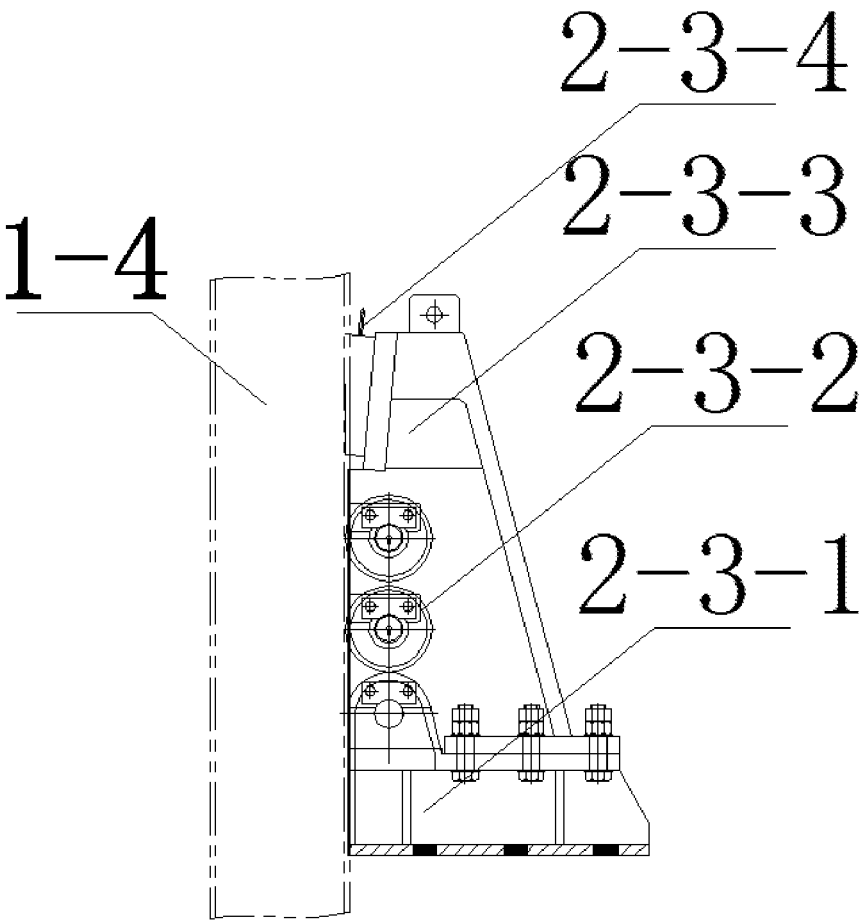
FIG. 4 is a structural schematic diagram of a roller support device.

In embodiment 7, referring to what is shown in FIG. 4, at least one roller support device 2-2 is respectively provided at each of two sides to which the lift tower 1 swings relative to the vertical direction, wherein each roller support device 2-2 includes: a base 2-2-1, a roller 2-2-2 and a roller carrier 2-2-3, the base 2-2-1 is mounted on the jacking frame 2, the roller carrier 2-2-3 is mounted on the base 2-2-1, and the roller 2-2-2 is rotatably connected with one side of the roller carrier 2-2-3 and the roller 2-2-2 abuts the lift tower 1, wherein when the lift tower 1 is raised or lowered, the roller 2-2-2 rotates in a vertical direction around an axis of itself.

In practical applications, each roller support device 2-2 is configured to limit a position of the lift tower 1 within the first moon pool to prevent the transmission structure 1-1 on the lift tower 1 from departing from the respective lifting unit 2-1 when the lift tower 1 is subjected to impacts from ocean currents or ocean waves. Since a wedge structure can sustain a relatively large momentary force or a continuous force and has a stable structure, in the present embodiment, each roller carrier 2-2-3 employs a wedge structure, a space for mounting the respective roller 2-2-2 is provided in the roller carrier 2-2-3 at a side facing the respective tower pile 1-4, and the roller 2-2-2 is rotatably mounted in the roller carrier 2-2-3, with a wheel surface being provided to face the tower pule 1-4, wherein the wheel face of the roller 2-2-2 should slightly protrude from a plane portion where a right angle plane is located, and the wheel face is abutted against the tower pile 1-4. In the present embodiment, the roller support devices 2-2 are like the lifting units 2-1, four roller support devices 2-2 respectively are arranged corresponding to four tower piles 1-4, wherein each roller support device 2-2 and the lifting unit 2-1 on the corresponding tower pile 1-4 are orthogonally arranged, completely blocking the space in which horizontal displacement of the lift tower 1 may occur. Rollers with wide wheel face are selected as the rollers 2-2 to increase contact areas between the rollers 2-2-2 and the respective tower piles 1-4, so as to increase the frictional forces between the rollers 2-2-2 and the respective tower piles 1-4. In the present embodiment, multiple rollers 2-2-2 are provided, with axle centers thereof located on a same vertical line, and the multiple rollers 2-2-2 are mounted in a respective roller carrier 2-2-3 from top to bottom; in other embodiments, the multiple rollers 2-2-2 in each set of roller support device 2-2 also can be respectively mounted in one-to-one correspondence on multiple roller carriers 2-2-3, wherein the multiple roller carriers 2-2-3 are all mounted on the bases 2-2-1. When the lift tower 1 is raised or lowered, the rollers 2-2-2 rotate, closely abutting the respective tower piles 1-4. In the present embodiment, multiple reinforcing ribs, perpendicular to a side surface of the roller carrier 2-2-3 and the base 2-2-1, extend from a side surface of each roller carrier 2-2-3 and each base 2-2-1, wherein the reinforcing ribs are configured to strengthen the respective roller support device 2-2's ability of sustaining forces from various directions.

In embodiment 8, referring to what is shown in FIG. 4, a wedge groove is formed between the upper portion of each roller carrier 2-2-3 and the respective lift tower 1, wherein when the attitude of the lift tower 1 is fixed, a wedge for pile fixation, abutted against the wedge groove, is inserted in the wedge groove.

In practical applications, when the attitude of the lift tower 1 needs to be fixed, in addition to the brake device provided in the power device 2-1-2 (i.e. motor) in each lifting unit 2-1 assisting the lift tower 1 to maintain its attitude fixed, at the same time, a wedge for pile fixation with width decreasing from top to bottom is inserted in the respective wedge groove, which also can assist in avoiding falling of the lift tower 1 using the frictional force between the wedge for pile fixation and the respective tower pile 1-4, a handle 2-3-4 is provided above the wedge for pile fixation, after the brake device in the power device 2-1-2 stops the lift tower 1, the handle 2-3-4 may be manually held to insert the wedge for pile fixation; on the contrary, when the lift tower 1 is ready to be raised or lowered, the lift tower 1 should be raised first to take out the wedge for pile fixation during the process of raising, then operations for raising or lowering the lift tower 1 are to be performed.

In embodiment 9, referring to what is shown in FIG. 1, a sensor 5-2 and an electrical control system 5-1 are further included, wherein the sensor 5-2 is installed below the jacking frame 2 and is configured to sense a spacing between the lift platform 3 and the jacking frame 2, and the electrical control system 5-1 is in communication connection with the lifting units 2-1, the elevator 5-3 and the sensor 5-2 respectively.

In practical applications, the sensor 5-2 sends the spacing between the jacking frame 2 and the lift platform 3 to the electrical control system 5-1 in real time, when the electrical control system 5-1 performs operations of raising or lowering on the lift tower 1 by controlling the lifting units 2-1, it determines whether the lift platform 3 has arrived in place according to data of the spacing between the jacking frame 2 and the lift platform 3 sent from the sensor 5-2, for example, when the offshore platform embarkation facility is shifted to the use state, the electrical control system 5-1 acquires the spacing between the descending lift platform 3 and the jacking frame 2 in real time via the sensor 5-2, and takes data of the spacing between the platform and the sea surface transmitted from other sensors of the offshore platform as auxiliary comparison data, once the data of the spacing between the lift platform 3 and the jacking frame 2 is close to the above auxiliary comparison data, the lift platform 3 no longer descends with the lift tower 1, and the data of the spacing between the jacking frame 2 and the lift platform 3 fluctuates within a certain interval without increasing (taking the fluctuation of ocean waves into consideration), it can be determined that the lift platform 3 has arrived at a designated working position. When the offshore platform embarkation facility is shifted to the non-use state, the electrical control system 5-1 controls the lifting units 2-1 to retract the lift tower 1 and the lift platform 3 to leave the sea surface, when the data of the spacing between the jacking frame 2 and the lift platform 3 transmitted from the sensor 5-2 has reached data of a designated security spacing, the electrical control system 5-1 controls the lifting units 2-1 to stop providing power and to start a brake function, while inserting the wedge for pile fixation in each wedge groove. The electrical control system 5-1 should have an electrical control console, wherein the electrical control console may be provided on the offshore platform embarkation facility and may also be provided in the offshore platform.

An offshore platform, referring to what is shown in FIG. 7, includes the offshore platform embarkation facility described above, wherein when the offshore platform needs to move, the lifting units 2-1 enables the lift tower 1 to move upward by driving the transmission structures 1-1, to further elevate the lift platform 3 to leave the sea surface; and when the offshore platform needs to be stationed, the lifting units 2-1 enables the lift tower 1 to move downward by driving the transmission structures 1-1 such that the lift platform 3 is lowered onto the sea surface.

In practical applications, the entire offshore platform embarkation facility is installed at an edge of the offshore platform by the jacking frame 2, and when the offshore platform encounters heavy storms and waves, it is required to retract the offshore platform embarkation facility to the non-use state as quickly as possible to prevent ocean currents and ocean waves from heavily impacting the lift tower 1 and the lift platform 3 to damage the offshore platform embarkation facility and the offshore platform.

It is to be noted that, the above embodiments can be combined at will as needed. The above described is merely preferred embodiments of the present disclosure. It is to be indicated that for those ordinarily skilled in the art, various improvements and modifications may also be made without departing from the principle of the present disclosure, and these improvements and modifications also shall be considered as within the scope of protection of the present disclosure.

We claim:

1. An offshore platform embarkation facility, comprising:

a lift tower, wherein the lift tower is provided with a climbing device, and the lift tower is provided with a transmission structure;

a jacking frame, wherein a first moon pool allowing the lift tower to pass through is provided in the jacking frame;

a lifting unit, wherein the lifting unit is installed on the jacking frame, and the lifting unit is configured to cooperate with the transmission structure to raise and lower the lift tower; and a lift platform, wherein a second moon pool allowing the lift tower to pass through is provided in the lift platform, and the lift platform is connected with the lift tower via the climbing device, and the lift platform is located below the jacking frame, wherein at least one roller support device is respectively provided at each of two sides to which the lift tower swings relative to a vertical direction, wherein each of the at least one roller support device comprises: a base, a roller and a roller carrier, wherein the base is mounted on the jacking frame, the roller carrier is mounted on the base, and the roller is rotatably connected with one side of the roller carrier and abuts the lift tower, and when the lift tower is raised or lowered, the roller rotates in a vertical direction around an axis of itself.

2. The offshore platform embarkation facility according to claim 1, wherein a limiting device is fixedly mounted at a bottom end of the lift tower, and the limiting device is configured to restrict a movable range of the lift platform on the lift tower.

3. The offshore platform embarkation facility according to claim 2, further comprising at least one set of rollers, wherein the at least one set of rollers is mounted on the lift platform with rollers close to the second moon pool, and cooperates with the transmission structure, and the at least one set of rollers is configured to allow the lift platform to slide up and down along the lift tower.

4. The offshore platform embarkation facility according to claim 3, wherein the lift platform is hollow inside.

5. The offshore platform embarkation facility according to claim 4, wherein the climbing device at least comprises a stairway and an elevator, the stairway is arranged on the lift tower from top to bottom, an upper end of the stairway is connected with the jacking frame, a ramp is connected with a lower end of the stairway, a lower end of the ramp is capable of sliding on an upper surface of the lift platform and is configured to connect the lift platform with the stairway, the lower end of the stairway is provided with a limiting device configured to restrict a rotation angle of the ramp to a range of 15°~60°, and the elevator is arranged on the lift tower.

6. The offshore platform embarkation facility according to claim 1, wherein the lifting unit comprises a reduction device and a power device, wherein an output end of the power device is connected with an input end of the reduction device, and an output end of the reduction device cooperates with the transmission structure.

7. The offshore platform embarkation facility according to claim 1, wherein a wedge groove is formed between an upper portion of the roller carrier and the lift tower, and when an attitude of the lift tower is fixed, a wedge for pile fixation is inserted in the wedge groove, with the wedge for pile fixation abutted against the wedge groove.

8. The offshore platform embarkation facility according to claim 7, further comprising a sensor and an electrical control system, wherein the sensor is installed below the jacking frame and is configured to sense a spacing between the lift platform and the jacking frame, and the electrical control system is in communication connection with the lifting unit, the elevator and the sensor respectively.

9. An offshore platform comprising the offshore platform embarkation facility according to claim 1, wherein when the offshore platform needs to move, the lifting unit enables the lift tower to move upward by driving the transmission structure, so as to elevate the lift platform to leave a sea surface; and when the offshore platform needs to be stationed, the lifting unit enables the lift tower to move downward by driving the transmission structure such that the lift platform is lowered onto the sea surface;

wherein at least one roller support device is respectively provided at each of two sides to which the lift tower swings relative to a vertical direction, wherein each of the at least one roller support device comprises: a base, a roller and a roller carrier, wherein the base is mounted on the jacking frame, the roller carrier is mounted on the base, and the roller is rotatably connected with one side of the roller carrier and abuts the lift tower, and when the lift tower is raised or lowered, the roller rotates in a vertical direction around an axis of itself.

10. The offshore platform according to claim 9, wherein a limiting device is fixedly mounted at a bottom end of the lift tower, and the limiting device is configured to restrict a movable range of the lift platform on the lift tower.

11. The offshore platform according to claim 10, further comprising at least one set of rollers, wherein the at least one set of rollers is mounted on the lift platform with rollers close to the second moon pool, and cooperates with the transmission structure, and the at least one set of rollers is configured to allow the lift platform to slide up and down along the lift tower.

12. The offshore platform according to claim 11, wherein the lift platform is hollow inside.

13. The offshore platform according to claim 12, wherein the climbing device at least comprises a stairway and an elevator, the stairway is arranged on the lift tower from top to bottom, an upper end of the stairway is connected with the jacking frame, a ramp is connected with a lower end of the stairway, a lower end of the ramp is capable of sliding on an upper surface of the lift platform and is configured to connect the lift platform with the stairway, the lower end of the stairway is provided with a limiting device configured to restrict a rotation angle of the ramp to a range of 15°~60°, and the elevator is arranged on the lift tower.

14. The offshore platform according to claim 9, wherein the lifting unit comprises a reduction device and a power device, wherein an output end of the power device is connected with an input end of the reduction device, and an output end of the reduction device cooperates with the transmission structure.

15. The offshore platform according to claim 9, wherein a wedge groove is formed between an upper portion of the roller carrier and the lift tower, and when an attitude of the lift tower is fixed, a wedge for pile fixation is inserted in the wedge groove, with the wedge for pile fixation abutted against the wedge groove.

16. The offshore platform according to claim 15, further comprising a sensor and an electrical control system, wherein the sensor is installed below the jacking frame and is configured to sense a spacing between the lift platform and the jacking frame, and the electrical control system is in communication connection with the lifting unit, the elevator and the sensor respectively.

* * * * *